United States Patent [19]

Todd

[11] Patent Number: 4,457,677

[45] Date of Patent: Jul. 3, 1984

[54] HIGH TORQUE, LOW SPEED HYDRAULIC MOTOR

[76] Inventor: William H. Todd, 5530 Renolda Dr., Winston-Salem, N.C. 27106

[21] Appl. No.: 327,271

[22] Filed: Dec. 4, 1981

[51] Int. Cl.[3] ..... F03C 2/08

[52] U.S. Cl. ..... 418/61 B; 417/310

[58] Field of Search ..... 418/61 B, 134, 57; 417/283, 310

[56] References Cited

U.S. PATENT DOCUMENTS

| | | | |
|---|---|---|---|
| 69,383 | 10/1867 | Andrew | 418/134 |
| 2,676,463 | 4/1954 | Klessig | 417/310 |
| 3,514,234 | 5/1970 | Albers et al. | 418/61 B |
| 3,572,983 | 3/1971 | McDermott | 418/61 B |
| 3,606,598 | 9/1971 | Albers | 418/61 B |
| 3,658,450 | 4/1972 | Woodling | 418/61 B |
| 3,841,801 | 10/1974 | Sturlason et al. | 418/61 B |
| 3,895,888 | 7/1975 | Roberts | 418/61 B |
| 3,899,270 | 8/1975 | Swedberg | 418/61 B |
| 4,032,267 | 6/1977 | Miller | 418/61 B |
| 4,076,462 | 2/1978 | Pippenger | 417/310 |
| 4,232,708 | 11/1980 | Miller | 418/61 B |

FOREIGN PATENT DOCUMENTS

| | | | |
|---|---|---|---|
| 1553285 | 1/1970 | Fed. Rep. of Germany | 418/61 B |
| 2502104 | 7/1975 | Fed. Rep. of Germany | 418/61 B |

*Primary Examiner*—John J. Vrablik

*Attorney, Agent, or Firm*—Bell, Seltzer, Park & Gibson

[57] ABSTRACT

A high torque, low speed hydraulic motor is disclosed which comprises a gerotor type rotary displacement assembly which is composed of an outer ring and an internal, eccentrically mounted star. The outer ring of the assembly is fixed to and rotates with the drive shaft, and the inner star is held against rotation by a universal shaft linkage. A fluid valve is provided for the gerotor assembly which comprises a timing plate and a spool having cooperating flat faces, and the two faces are adjustably biased together to permit control of fluid leakage therebetween.

11 Claims, 7 Drawing Figures

HIGH TORQUE, LOW SPEED HYDRAULIC MOTOR

The present invention relates to a hydraulic motor adapted to convert hydraulic pressure and flow into a high torque and low speed rotation of an output drive shaft. The motor is also adapted to function in the reverse mode as a pump, and wherein torque is applied to the output shaft to cause the hydraulic fluid to flow therethrough.

In one conventional hydraulic motor of the described type, a cylindrical, spool-like timing valve is operatively connected to a drive shaft, and the timing valve includes cooperating slots for transmitting the fluid to a rotary displacement assembly of the type commonly referred to as a gerotor gearset. The gerotor gearset comprises a fixed outer ring and a rotatable inner star, and a relatively long universal drive linkage is provided for transmitting the torque from the star to the drive shaft, and thus also to the timing valve. A motor of this general type is further described in the U.S. Pat. No. 3,606,598 to Albers. While motors of this design are in commercial use, they are seen to incorporate an inherent weakness in that the drive linkage is directly subjected to the output torque, and by reason of its long length, the linkage is susceptible to breakage, or rotational twisting which would result in a misalignment of the timing slots of the timing valve. Also, the drive linkage is interconnected to the drive shaft by means of an internal gear formed in a cylindrical cavity in one end of the shaft, which tends to weaken the shaft.

In another conventional hydraulic motor design, the timing valve comprises a pair of cooperating flat timing plates positioned behind the gerotor gearset, with each of the plates having a series of circumferential openings which are sequentially brought into alignment as the plates rotate relative to each other to transmit the fluid to the gerotor gearset. One of the plates is fixed, and the other plate is rotated by a second universal drive linkage which is operatively connected to the star of the rotary displacement assembly. As in the above described design, a relatively long primary drive linkage interconnects the star and output shaft. A motor of this general type is further described in the U.S. Pat. to Swedberg, No. 3,899,270 and McDermott, No. 3,572,983. Here again, however, the primary drive linkage which extends between the star and output shaft is seen to provide a weak link.

It is accordingly an object of the present invention to provide a hydraulic motor of the described type wherein the above noted problems associated with the drive linkage for transmitting torque to the output drive shaft are effectively alleviated.

It is also an object of the present invention to provide a hydraulic motor of the described type which is of compact design, and which is modular in nature to facilitate its disassembly and repair.

It is a more particular object of the present invention to provide a hydraulic motor which utilizes a timing valve which is not part of the drive train, so that the timing valve is effectively precluded from getting out of alignment.

It is a further particular object of the present invention to provide a timing valve for a hydraulic motor which comprises relatively rotating flat surfaces, and which are adapted to function as a relief valve if the pressure in the hydraulic system becomes too great, and which also may be adjusted to release the driving torque and permit the motor to freewheel.

These and other objects and advantages of the present invention are achieved in the illustrated embodiment by the provision of a hydraulic motor which comprises a housing having a fluid inlet port and a fluid outlet port, a drive shaft rotatably mounted within the housing, and a gerotor type rotary displacement assembly mounted within the housing. The gerotor assembly is composed of an externally toothed star and an internally toothed outer ring, with the star being mounted eccentrically within the outer ring so as to define fluid chambers between the teeth which expand and contract as the star orbits about the central axis of the outer ring.

The motor further includes valve means mounted within the housing for directing pressurized hydraulic fluid from the inlet port to selected ones of the fluid chambers to expand the same, while exhausting fluid to the outlet port from the contracting fluid chambers. The expanding and contracting chambers thus serve to orbitally and rotationally move the star with respect to the outer ring. The valve means comprises a timing plate mounted adjacent the outer ring of the gerotor assembly, and a cooperating spool positioned on the side of the timing plate opposite the outer ring. In the preferred embodiment, the drive shaft is fixed to one side of the outer ring, and the timing plate is fixed to the other side of the outer ring. Also, the spool is held against rotation in the housing, and a universal linkage operatively interconnects the star and the spool so as to preclude rotation of the star about the drive shaft axis while permitting orbital movement thereof. Thus in operation, the flow of pressurized fluid into the inlet port causes the interconnected outer ring, timing plate, and drive shaft all to rotate about the drive shaft axis, while the star orbits about this axis, but is held against rotational movement by the linkage, which in turn is held against rotation by its interconnection with the spool.

As a further aspect of the invention, the spool is preferably mounted for limited axial movement, and adjustable biasing means is provided for biasing the spool axially toward the timing plate to control fluid leakage between the opposing faces thereof. Further, the housing defines an open chamber on the side of the spool opposite the timing plate, with the chamber communicating with the outlet port. Thus the fluid pressure in the chamber also acts to bias the spool toward the timing plate.

Some of the objects having been stated, other objects will appear as the description proceeds, when taken in connection with the accompanying drawings, in which FIG. 1 is a perspective view of a hydraulic motor embodying the features of the present invention;

Figure 1:
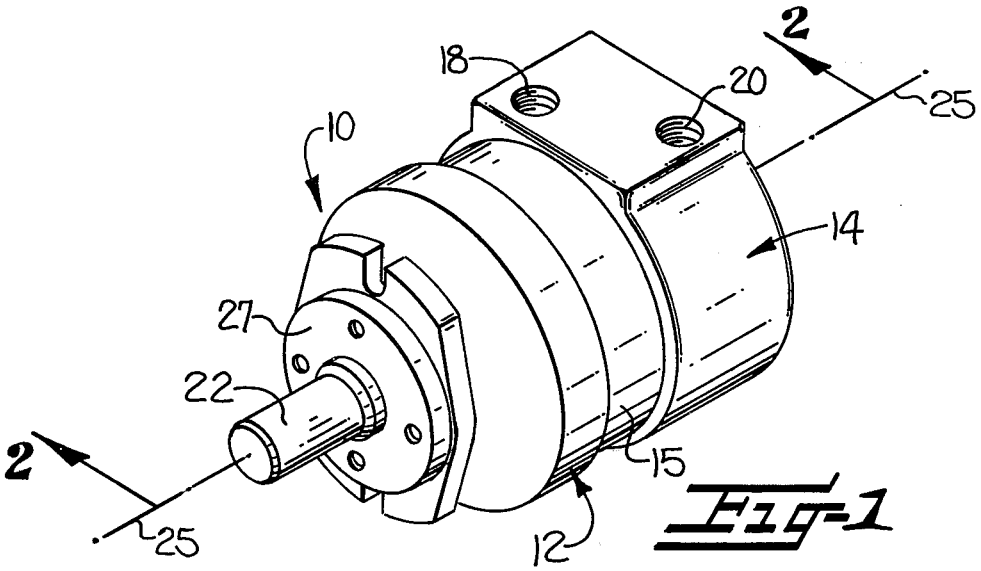
Figure 2:
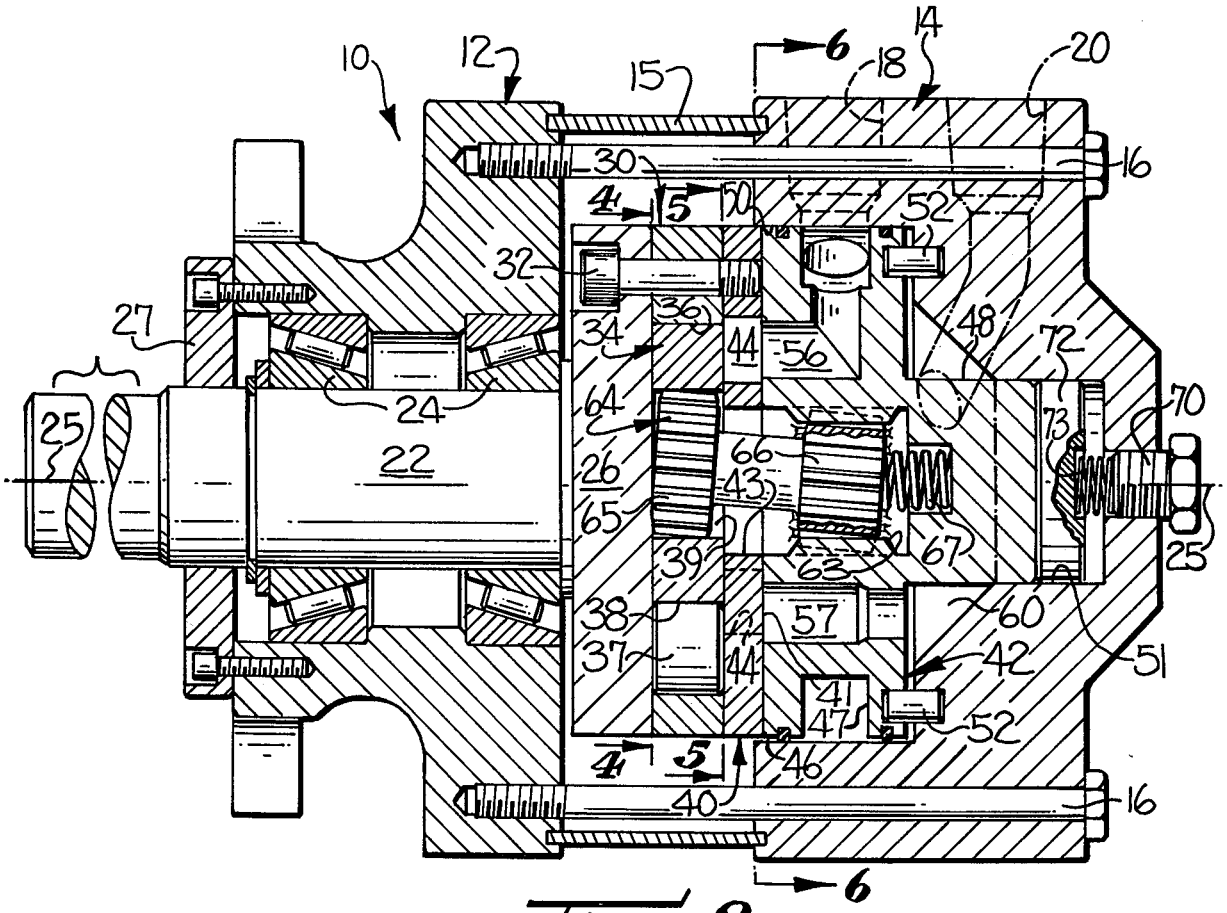
FIG. 2 is a sectioned elevation view taken substantially along the line 2—2 of FIG. 1.
Figure 3:
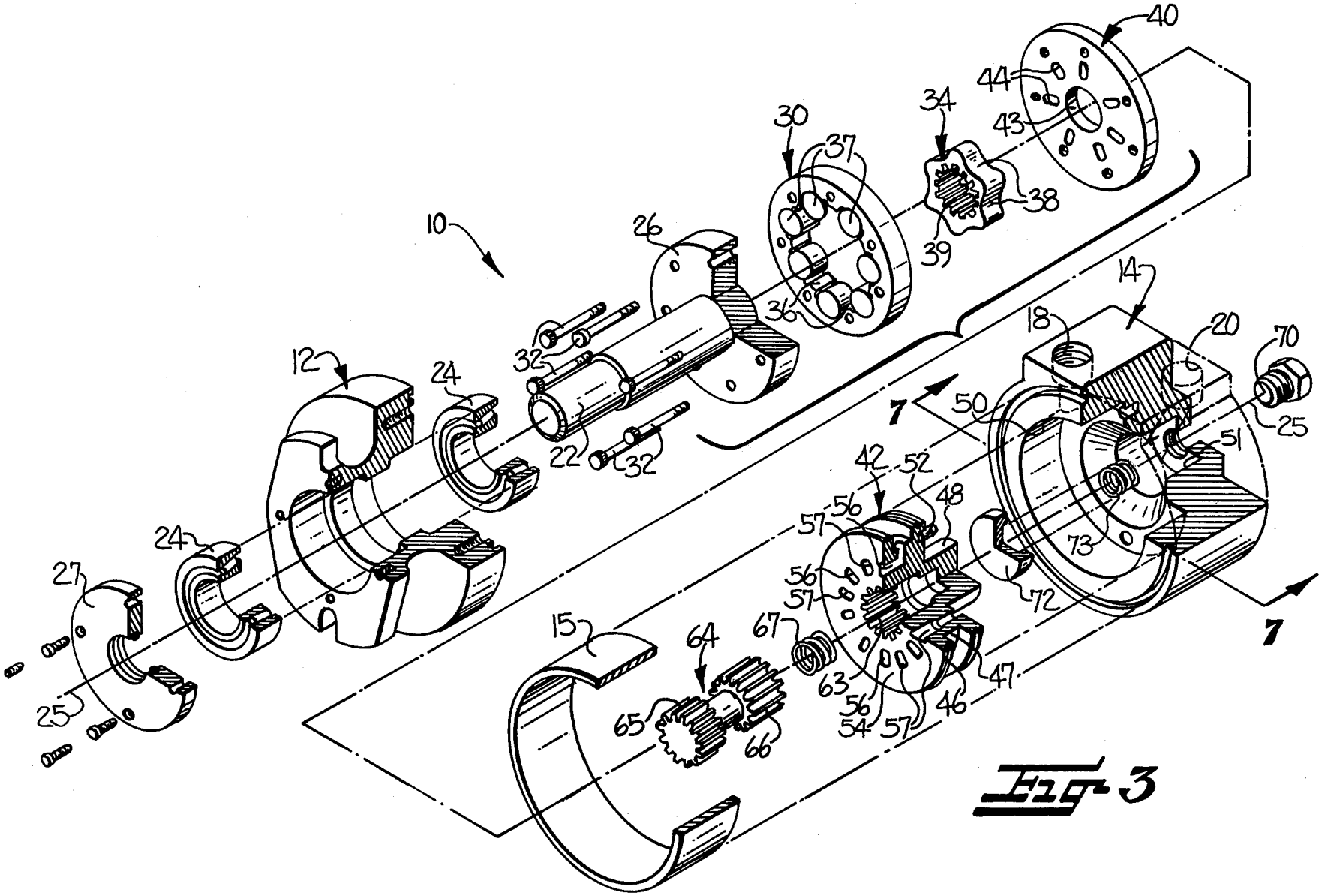
FIG. 3 is an exploded perspective view of the motor shown in FIG. 1.
Figure 4:
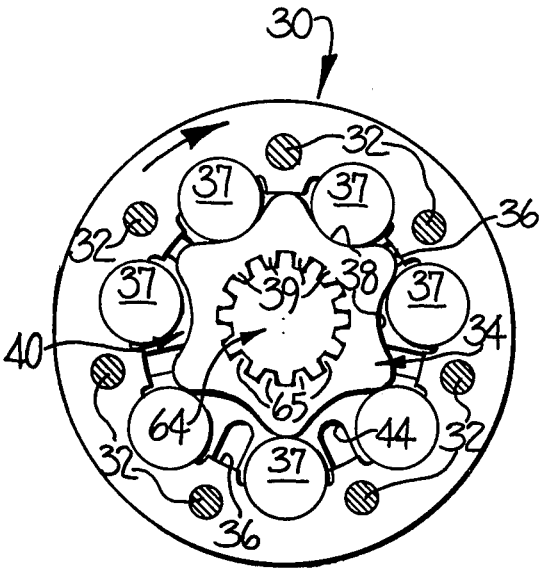
Figure 5:
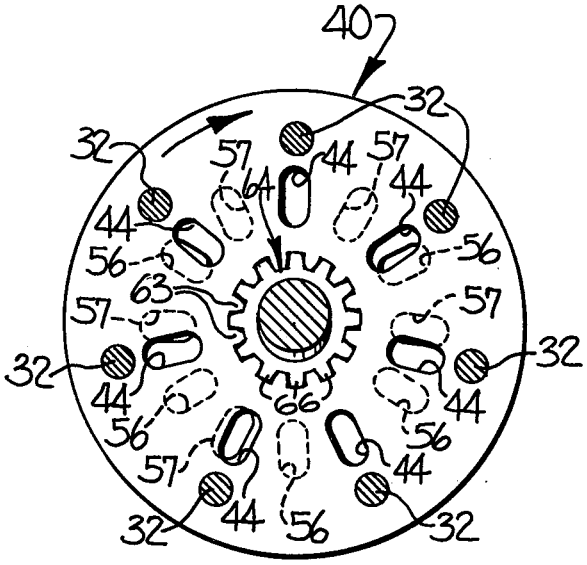
Figure 6:
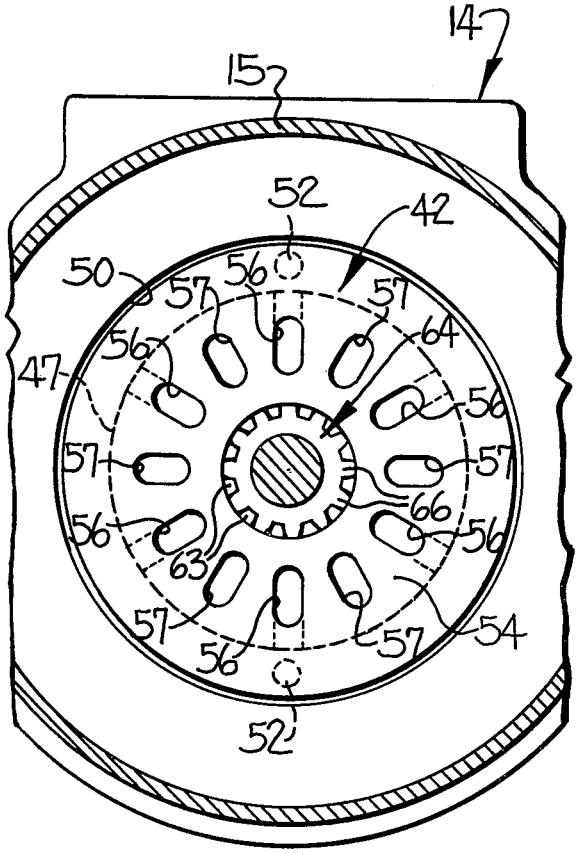
Figure 7:
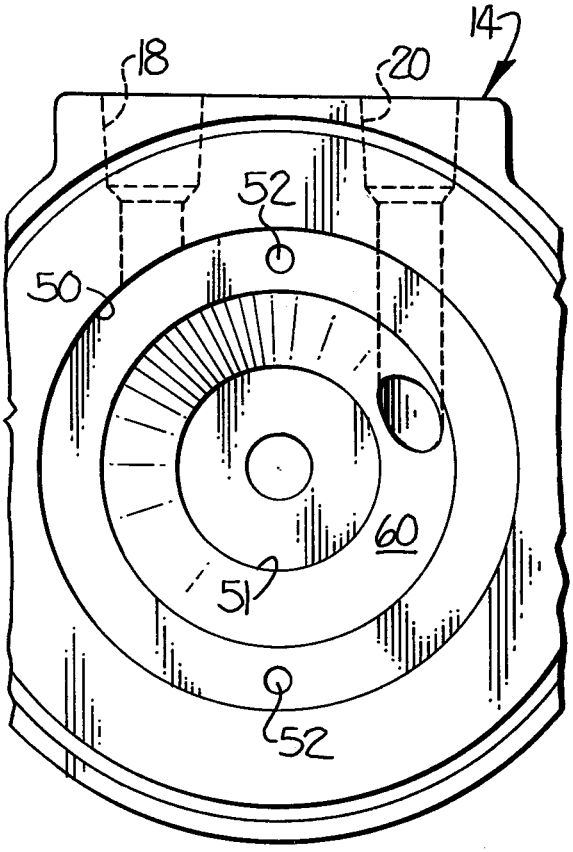

FIGS. 4, 5 and 6 are sectioned end views taken substantially along the lines 4—4, 5—5, and 6—6 of FIG. 2 respectively; and FIG. 7 is an end view of the rear housing segment taken in the direction of line 7—7 of FIG. 3.

Referring more particularly to the drawings, a hydraulic motor embodying the features of a preferred embodiment of the present invention is indicated generally at 10. In this regard, it should be understood that while the following description specifically refers to the apparatus as a "motor", it will be apparent that other uses, such as a hydraulic pump, are also possible, and the term "motor" is intended to encompass such other uses.

The motor 10 includes a housing assembly composed of a forward segment 12 and a rear segment 14. A cylindrical ring 15 is disposed between the two segments, and the components are held together by a number of bolts 16, which permit its ready disassembly. Also, the rear segment 14 of the housing includes a fluid inlet port 18 and a fluid outlet port 20. A drive shaft 22 is rotatably mounted within the housing by means of conventional roller bearings 24 and defines a central axis 25. The shaft 22 is solid throughout its length, and the inner end of the shaft includes an integral flange 26. A cover plate 27 closes the forward end of the housing about the shaft.

The motor further includes a rotary displacement assembly mounted within the housing which serves to convert the hydraulic pressure into rotation of the output shaft 22. The rotary displacement assembly is in the form of a conventional gerotor gearset, which includes an outer ring 30 fixed by the bolts 32 to the flange 26 of the output shaft, and a cooperating star 34. The outer ring 30 includes an internal gear 36, which is coaxially disposed about the central axis 25, with the teeth of such internal gear being defined by a plurality of rollers 37 spaced about the internal periphery of the ring. The star 34 has an outer periphery 38 defining a number of teeth which is one less than the number of teeth in the internal gear 36 of the ring. The star also includes a central opening therethrough which is in the form of an internal gear 39. The toothed star 34 is eccentrically mounted within and meshes with the internal gear 36 of the ring, and thus the star is adapted for orbital movement with respect to the ring, so as to define expanding and contracting fluid chambers between the gear teeth thereof.

Valve means is also mounted within the housing for directing hydraulic fluid from the inlet port 18 (or outlet port 20) to selected ones of the fluid chambers of the gerotor gearset so as to cause the chambers to expand, while exhausting fluid from the contracting chambers to the outlet port 20 (or inlet port 18). By this arrangement, the star 34 is caused to orbit about the central axis 25 with respect to the outer ring 30. This valve means includes a timing plate 40 fixedly mounted to the outer ring 30 of the gerotor gearset by the bolts 32, and an adjacent spool 42. The timing plate 40 has a flat face 41 disposed perpendicular to the central axis and facing opposite the outer ring 30. The plate 40 also includes a central opening 43 and a plurality of axially directed passageways 44 which are adapted to selectively communicate with the fluid chambers of the gerotor gearset.

The spool 42 of the valve means is mounted within the housing in a manner which permits limited axial movement, while precluding relative rotational movement. More particularly, the spool 42 has a cylindrical portion 46 which includes a radially directed channel 47 in the periphery which communicates with the inlet port 18. Also, the spool 42 includes a cylindrical end extension 48, and the housing includes cylindrical internal wall segments 50 and 51 for receiving the portions 46 and 48 of the spool respectively. A plurality of axial pins 52 mount the spool within the housing, so as to permit limited axial movement while precluding relative rotation. The spool 42 also has a flat, forward face 54 disposed perpendicular to the central axis and directly opposing the flat face 41 of the timing plate 40. The face 54 of the spool includes a first set of axially directed openings 56 (note FIG. 6) communicating with the channel 47 and thus the inlet port 18. A second set of axially directed openings 57 extend completely through the spool and communicate with a chamber 60 formed between the rear side of the spool and that portion of the interior wall of the housing segment between the cylindrical wall segments 50 and 51. The chamber 60 in turn communicates with the outlet port 20. The openings 56 and 57 selectively communicate with respective ones of the passageways 44 through the plate 40 upon relative rotation of the plate and spool in the manner further described below. Also, the spool includes a forward cavity having an internal gear 63 which is coaxially disposed about the central axis.

The illustrated motor further includes a universal linkage 64 operatively interconnecting the star and the spool for precluding rotation of the star about the axis 25, while permitting orbital movement of the star. The linkage 64 is in the form of a shaft which extends through the opening 43 of the plate 40, and has an external gear 65 at one end meshing with the internal gear 39 of the star, and an external gear 66 at the other end meshing with the internal gear 63 of the spool. A spring 67 is positioned between the end of the linkage and inner wall of the spool cavity to resiliently maintain the linkage in its proper position.

The rear end of the housing segment 14 mounts means for adjustably biasing the spool 42 axially toward the timing plate 40 to thereby control fluid leakage therebetween. This biasing means includes a threaded member 70 which is threaded through a threaded opening in the housing segment 14, and which is axially aligned with the central axis 25 and communicates with the cylindrical cavity 51. A pressure plate 72 is positioned within the cavity to abut the end of the extension 48 of the spool, and a spring 73 is interposed between the inner end of the threaded member and the plate. Thus the biasing force may be increased by threading the threaded member 70 into the housing (toward the left as seen in FIG. 2), and the pressure may be reduced or totally released by unthreading the threaded member from the housing.

When operating as a hydraulic motor, the pressurized fluid may enter either of the ports 18 or 20, to permit operation in either rotational direction. Assuming the pressurized fluid enters through the port 18, it will flow into the channel 47 of the spool and then will pass through the openings 56 and aligned passageways 44 of the timing plate and into selected ones of the fluid chambers between the teeth of the outer ring 30 and star 34. This causes these chambers to expand, and the outer ring and shaft to rotate, with the fluid in the contracting fluid chambers passing through other aligned passageways 44 and openings 57 to the chamber 60 and outlet port 20. Generally, the fluid will be directed into three fluid chambers along one side of the star, and will exhaust from three fluid chambers along the other side. The pressure of the fluid in the chamber 60 tends to bias the spool axially toward the timing plate, so as to hold the opposing faces 41 and 54 in operative engagement. Also, it will be noted that the relatively short linkage 64 does not rotate, and it does not transmit the output torque to the drive shaft. Further, the linkage does not control the timing of the timing plate and spool. Thus the linkage is not readily susceptible to breakage, and proper timing of the valve is not effected by any slight twisting of the linkage.

It will also be apparent that the adjustability of the biasing force imparted by the threaded member 70 permits the motor to start at low fluid pressures by assuring that the spool and timing plate are initially held together. The threaded member 70 also may function as an adjustable relief valve by permitting the faces 41 and 54 to separate if the pessure in the system becomes too high. Still further, the threaded member 70 may be unthreaded to permit the timing spool to be effectively withdrawn from the timing plate and thereby permit the motor to freewheel.

As further advantages of the present invention, it will be observed that the outer ring 30 and the timing plate 40 are both fixed to the flange 26 of the drive shaft. Thus substantial mass is added to the drive shaft at a point radially spaced from its axis, and this added mass is seen to create a flywheel effect which serves to render rotation more uniform under changing load conditions. Also, it will be noted that the drive shaft and attached outer ring and timing plate are modular in nature, and may be easily removed and replaced as a unit when the housing is opened. Still further, the shaft 22 is solid throughout its length, and thus is not weakened by the presence of an internal cavity which is utilized in certain of the prior motor designs for receiving a drive linkage.

In the drawings and specification, there has been set forth a preferred embodiment of the invention, and although specific terms are employed, they are used in a generic and descriptive sense only and not for purposes of limitation.

That which is claimed is:

1. A hydraulic motor adapted for high torque, low speed operation, and comprising a housing having a fluid inlet port and a fluid outlet port, a drive shaft rotatably mounted within said housing, and defining a drive shaft axis, gerotor means mounted within said housing and comprising an externally toothed star and an internally toothed outer ring, said star being mounted eccentrically within said outer ring so as to define fluid chambers between the teeth thereof, with said outer ring being fixed coaxially to said drive shaft, valve means mounted within said housing for directing pressurized hydraulic fluid from said inlet port to selected ones of the fluid chambers, while exhausting fluid to said outlet port from selected others of the fluid chambers, and so as to selectively expand and contract the fluid chambers and thereby orbitally move said star and rotationally move said outer ring with respect to said star, said valve means comprising (a) a timing plate fixedly mounted to said outer ring and having a flat face disposed perpendicular to said drive shaft axis and facing opposite from said outer ring, said timing plate further including a plurality of axially directed passageways extending therethrough for selectively communicating with the fluid chambers of said gerotor means, and (b) a spool mounted within said housing coaxially with said drive shaft and so as to preclude relative rotation with respect to said housing, said spool having a flat face disposed perpendicular to said drive shaft axis and directly opposing said flat face of said plate, with said timing spool flat face having a first set of openings communicating with said inlet port and a second set of openings communicating with said outlet port, with the openings of both sets selectively communicating with respective ones of the passageways through said timing plate upon relative rotation of said plate and spool, and linkage means operatively interconnecting said star and said spool for precluding rotation of said star above drive shaft axis while permitting orbital movement of said star, whereby the flow of pressurized fluid into either one of said inlet port and said outlet port causes said outer ring, said timing plate, and said drive shaft all to rotate about said drive shaft axis, while said star orbits about said axis but is held against rotational movement by said linkage means, and with the fluid exhausting through the other port.

2. The hydraulic motor as define in claim 1 wherein said spool of said valve means is mounted within said housing so as to permit limited axial movement, and said motor further comprises means for biasing said spool axially toward said timing plate to control fluid leakage between the opposing faces thereof.

3. The hydraulic motor as defined in claim 2 wherein said biasing means includes a threaded member mounted in a threaded opening which extends through said housing, and resilient means interposed between the inner end of said threaded member and said spool, whereby the biasing force may be adjustably controlled by threadedly advancing or withdrawing said threaded member with respect to said housing.

4. The hydraulic motor as defined in any one of claims 1, 2, or 3, wherein said spool has a cylindrical peripheral portion, and includes a radially directed continuous channel in said peripheral portion which communicates with said inlet port, and with said first set of openings of said spool communicating with said channel.

5. The hydraulic motor as defined in claim 4 wherein said housing defines an open chamber on the side of said spool opposite said timing plate, with said outlet port communicating with said chamber, and with said second set of openings of said spool extending axially through said spool so as to communicate with said chamber.

6. The hydraulic motor as defined in claim 5 wherein said linkage means comprises an internal gear in said star, an internal gear in said spool, a central opening through said timing plate, and a shaft having external gears at each end, with the shaft extending through said central opening and with the external gears meshing with respective ones of said internal gears.

7. A hydraulic motor adapted for high torque, low speed operation, and comprising a housing having a fluid inlet port and a fluid outlet port, a drive shaft rotatably mounted within said housing, and defining a drive shaft axis, gerotor means mounted within said housing and comprising an externally toothed star and an internally toothed outer ring, said star being mounted eccentrically within said outer ring so as to define fluid chambers between the teeth thereof, with said outer ring being mounted coaxially with respect to said drive shaft axis, valve means mounted within said housing for directing pressurized hydraulic fluid from said inlet port to selected ones of the fluid chambers, while exhausting fluid to said outlet port from selected others of the fluid chambers, and so as to selectively expand and contract the fluid chambers and thereby orbitally move said star and rotationally move said outer ring with respect to said star, said valve means comprising (a) a timing plate mounted adjacent said outer ring and having a flat face disposed perpendicular to said drive shaft axis and facing opposite from said outer ring, said timing plate further having a plurality of axially directed passageways extending therethrough for selectively communicating with the fluid chambers of said gerotor means, and (b) a spool mounted within said housing so as to permit limited axial movement and having a flat face disposed perpendicular to said drive shaft axis and directly opposing said flat face of said timing plate, with said spool flat face having a first set of openings communicating with said inlet port and a second set of openings communicating with said outlet port, and with the openings of both sets selectively communicating with respective ones of the passageways through said timing plate upon relative rotation of said plate and spool, linkage means for operatively transmitting the relative rotation between said outer ring and star to said valve means and said drive shaft, so as to relatively rotate said timing plate with respect to said spool, and to rotate said drive shaft about said drive shaft axis, and means accessible from the exterior of said housing for adjustably biasing said spool axially toward said timing plate to control fluid leakage therebetween, said biasing means including a threaded member mounted in a threaded opening extending through said housing so as to be substantially coaxial with said drive shaft axis, whereby the flow of pressurized fluid into either one of said inlet port and said outlet port causes said outer ring to rotate with respect to said star, said timing plate to rotate with respect to said spool, and said drive shaft to rotate about said drive shaft axis, and with the fluid exhausting through the other port.

8. The hydraulic motor as defined in claim 7 wherein said housing defines an open chamber on the side of said spool opposite said timing plate, with said outlet port communicating with said chamber, and with said second set of openings extending axially through said spool to communicate with said chamber, and such that the pressure of the fluid in said chamber and outlet port acts to bias said spool axially toward said timing plate.

9. The hydraulic motor as defined in claim 8 wherein said housing includes a cylindrical cavity which is coaxial with said drive shaft axis, and said spool includes a cylindrical end extension which is closely and slideably received in said housing cavity so as to close communication between said open chamber and the inner end of said cavity, and such that said threaded member operatively engages the end of said spool end extension adjacent the inner end of said cavity.

10. The hydraulic motor as defined in claim 9 wherein said adjustable biasing means further comprises resilient means interposed between the inner end of said threaded member and said spool.

11. The hydraulic motor as defined in claim 10 wherein said shaft is solid throughout its length, and said linkage means includes means fixedly interconnecting said outer ring and said timing plate to said drive shaft, and said spool is mounted within said housing so as to preclude relative rotation between said spool and said housing.

* * * * *